US008887946B2

(12) United States Patent
Bruhat et al.

(10) Patent No.: US 8,887,946 B2
(45) Date of Patent: Nov. 18, 2014

(54) DEVICE FOR ASSEMBLY BY ELASTIC INTERLOCKING

(75) Inventors: Stéphane Bruhat, Aurillac (FR); Marc Delmon, Aurillac (FR)

(73) Assignee: Qualipac, Neuilly sur Seine (FR)

( * ) Notice: Subject to any disclaimer, the term of this patent is extended or adjusted under 35 U.S.C. 154(b) by 0 days.

(21) Appl. No.: 14/127,075

(22) PCT Filed: Jun. 25, 2012

(86) PCT No.: PCT/FR2012/051452

§ 371 (c)(1), (2), (4) Date: Dec. 17, 2013

(87) PCT Pub. No.: WO2012/175897

PCT Pub. Date: Dec. 27, 2012

(65) Prior Publication Data

US 2014/0166678 A1 Jun. 19, 2014

(30) Foreign Application Priority Data

Jun. 24, 2011 (FR) ..... 11 55609

(51) Int. Cl.
*B65D 55/00* (2006.01)
*B05B 11/00* (2006.01)

(52) U.S. Cl.
CPC ..... *B65D 55/00* (2013.01); *B05B 11/3047* (2013.01); *B05B 11/3049* (2013.01)
USPC ..... 220/694; 220/319; 215/216; 215/42

(58) Field of Classification Search
CPC .. B65D 50/046; B65D 50/045; B65D 50/043; B65D 41/0471; F16J 15/0887
USPC ..... 220/216, 42, 43, 40, 364, 358, 355, 220/319, 315, 694; 222/402.1; 277/631
See application file for complete search history.

(56) References Cited

U.S. PATENT DOCUMENTS 3,245,693 A * 4/1966 Way ..... 277/631
8,590,749 B2 11/2013 Beranger et al.
2009/0001103 A1 1/2009 Wanbaugh

FOREIGN PATENT DOCUMENTS

FR 2945283 A1 11/2010
WO 2009143148 A1 11/2009

* cited by examiner

*Primary Examiner* — Robert J Hicks
(74) *Attorney, Agent, or Firm* — Im IP Law PLLC; C. Andrew Im

(57) ABSTRACT

An assembly device comprises an external element and an open-loop ring. The external element comprises a tubular part extending along an axis. The open-loop ring is elastically deformable between an open position and a closed position. The external element comprises an assembly part assemblable with the ring by elastic interlocking. The assembly part comprises recessed elements and/or projecting elements arranged on an internal wall of the tubular part. The ring comprises first assembly part assemblable with the external element by elastic interlocking when the ring is in the open position, and the second assembly part interlocking with the external element by elastic interlocking when the ring is in the closed position. Such elastic interlocking assembly device allows for the irreversible assembly of the external element with a container neck.

9 Claims, 3 Drawing Sheets

DEVICE FOR ASSEMBLY BY ELASTIC INTERLOCKING

RELATED APPLICATIONS

This application is a §371 application from PCT/FR2012/051452 filed Jun. 25, 2012, which claims priority from French Patent Application No. 11 55609 filed Jun. 24, 2011, each of which is herein incorporated by reference in its entirety.

TECHNICAL FIELD OF THE INVENTION

This invention relates to an assembly device for attaching, by elastic interlocking, an external element having a tubular part to an internal element having a cylindrical part.

One particular application of the invention can be found in the field of packaging, particularly for cosmetic products.

BACKGROUND OF THE INVENTION

The field of packaging, and particularly for cosmetic products, is currently undergoing significant development. With the purpose of obtaining a result that is both aesthetic and functional, cosmetic product packaging can implement numerous elements manufactured separately, often made from different materials, which are then assembled together.

There is therefore a need for assembly devices implementing a simple method and adapted to suit industrial production.

Numerous cosmetic products, in particular liquids, are presented in bottles equipped with necks. Such a bottle is generally fitted with a dispensing device, such as a pump mounted underneath a push actuator. The dispensing device can be attached to the bottle neck by interlocking or by another attachment means such as crimping. A collar is usually placed around the neck to hide the attachment of the dispensing device.

The invention relates to a device aiming at assembling a container neck with an external element such as a dispensing device or collar.

Interlocking methods are known, implementing an attachment ring placed between the external element and the neck. Such a method is, for example, described in document FR2945283. During the interlocking process, the ring becomes deformed in an irreversible manner, thus ensuring the permanent assembly of the device.

Another interlocking method, described in document WO09143148, implements a closed-loop ring which rests against the dispensing device, said ring having a skirt formed from tabs that can be elastically deformed in a radial direction, said tabs capable of latching onto the neck of the container.

One disadvantage of these methods is that the ring and the collar create a double thickness around the dispensing device, which increases the size of the assembly.

OBJECT AND SUMMARY OF THE INVENTION

This invention proposes a particularly simple and effective solution when compared to known devices. This solution is based on an attachment ring in the form of an open-loop ring, said ring being capable of moving from an open position to a closed position during device assembly.

More precisely, the invention relates to an assembly device comprising: an external element, comprising a tubular part extending along a first axis; a ring in the form of an open-loop ring, which is elastically deformable between an open position and a closed position, said open position being characterized by a first inner diameter of the ring, said closed position being characterized by a second inner diameter of the ring, the second diameter being less than the first diameter; the external element comprising means for assembly with the ring by elastic interlocking, said means comprising recessed elements and/or projecting elements arranged on an internal wall of the tubular part; the ring comprising first means of assembly by elastic interlocking with the external element, comprising first elements positioned on an external wall of said ring, said first elements having a shape complementing that of the elements positioned on an internal wall of the tubular part, said shape being understood as complementary when the ring is in the open position; the ring comprising second means of assembly by elastic interlocking with the external element, comprising second elements positioned on an external wall of said ring, said second elements having a shape complementing that of the elements positioned on an internal wall of the tubular part, said shape being understood as complementary when the ring is in the closed position.

Preferably, the device also comprises an internal element fitted with a substantially cylindrical neck extending along a second axis, said neck comprising a flange at a first end, a second end of said neck being connected to a shoulder forming an abutment, a first outer diameter of the neck at said flange being substantially equal to the first inner diameter of the ring, a second outer diameter of the neck at a position away from said flange being substantially equal to the second inner diameter of the ring.

The open-loop shape of the ring enables it to cross the flange of the neck during assembly with the internal element. At the end of the assembly process, the ring therefore does not rest on the flange, which is only encircled by the external element. The size of the assembly is therefore reduced, with the tubular part of the external element capable of having a lower diameter than in the prior art.

The invention also relates to a method for assembling such a device, comprising the following steps:

- the ring in the open position is positioned in the tubular part of the external element, the assembly means of the external element being interlocked with the first assembly means of the ring,
- the ring and the external element are positioned around the flange of the neck so as to bring the first axis in line with the second axis,
- a pushing force is exerted on the external element in the direction of the second end of the neck,
- the ring thus abuts against the shoulder,
- the external element then moves in relation to the ring along the axes, said movement inducing a radial force towards the center of the ring so as to move the ring into the closed position,
- the assembly means of the external element interlock with the second assembly means of the ring.

Such a method is easy to implement and can be automated.

Preferably, the ring and/or the external element comprise elements configured so as to form an acute angle with the first axis when the ring is assembled with the external element. Therefore, during a relative movement of the ring and the external element along said first axis, the sliding of said elements forming such an acute angle induces a radial force towards the center of the ring. The latter therefore moves from the open position to the closed position.

Preferably, the internal element is a container having a neck fitted with a device for dispensing a fluid product. This in particular relates to a container and a dispensing device adapted to suit a cosmetic product in liquid, mousse or cream form.

BRIEF DESCRIPTION OF THE DRAWINGS

The invention will be better understood after reading the following description and after examining the accompanying figures. These are presented as a rough guide and in no way as a limited guide to the invention. The figures show.

DETAILED DESCRIPTION OF THE EMBODIMENTS

Figure 1A:
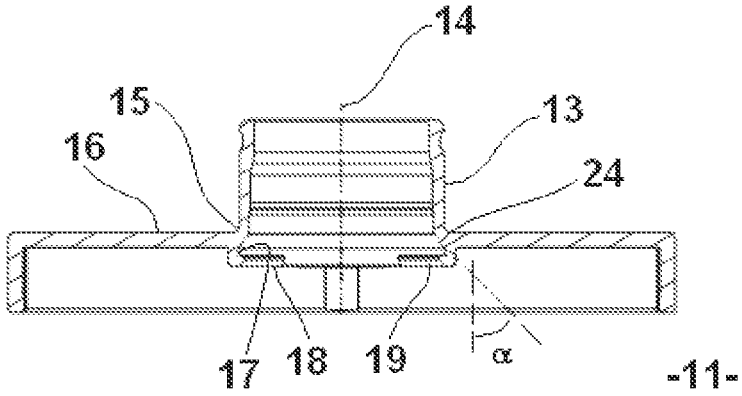
FIGS. 1*a*, 1*b* and 1*c*: views of the elements of an assembly device according to one embodiment of the invention.
Figure 1B:
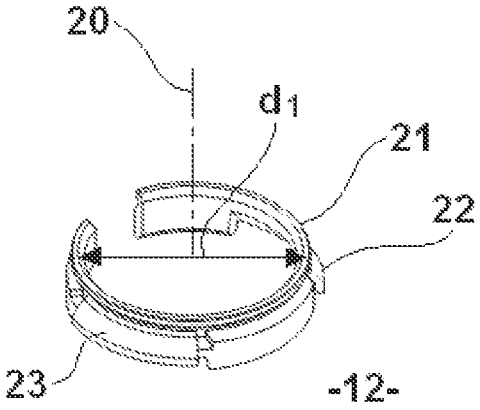
Figure 1C:
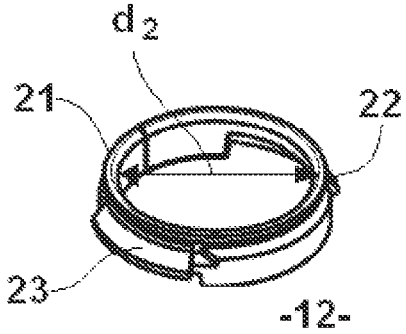

FIGS. 1*a*, 1*b* and 1*c* provide views of the elements of an assembly device 10 according to one embodiment of the invention.

FIG. 1*a* shows a cross-sectional view of an external element 11. In the embodiment represented in FIG. 1*a*, the element 11 is a collar intended to be positioned on a neck of a container, for example in order to hide the crimping of a dispensing pump attached to said neck.

FIGS. 1*b* and 1*c* represent perspective views of an attachment ring 12, designed to assemble by elastic interlocking, the collar 11 with a neck of a container.

In FIG. 1*a*, a tubular part 13 of the collar 11 can be seen. The tubular part 13 is substantially cylindrical in shape, extending along an axis 14. In the embodiment represented in FIG. 1*a*, the cylinder has a substantially circular cross-section. Alternatively, the cylinder can have an oval cross-section.

At one of its ends 15, the tubular part 13 is connected to a substantially flat plate 16, substantially perpendicular to the axis 14, designed to cover the top of a container. The part 13 crosses through the plate 16 so as to form an orifice in said plate.

The tubular part 13 comprises means for assembly with the ring 12 by elastic interlocking. These means in particular comprise a recessed element 17, in this case a groove which extends along the internal wall of the part 13, substantially perpendicular to the axis 14. In the example represented in FIG. 1*a*, the groove 17 and the plate 16 are substantially coplanar.

The assembly means also comprise projecting elements positioned on the internal wall of the part 13. These elements are tabs (18, 19) which extend along the groove 17 so as to be substantially symmetrical in relation to the axis 14.

On the side opposite the tabs (18, 19), the groove 17 comprises a part 24 with a substantially frustoconical and concave profile, the cross-section of which narrows as the distance from the tabs (18, 19) increases along the axis 14.

The profile of the part 24 forms an acute angle $\alpha$ with the axis 14. This angle $\alpha$ is preferably less than 45°, for example between 20° and 45°.

The attachment ring 12 is designed to cooperate with the means (17, 18, 19). The ring 12 is formed from elastically deformable material, for example plastic. The ring 12 has the shape of an open-loop ring and can move from an open position, represented in FIG. 1*b*, to a closed position, represented in FIG. 1*c*.

In both the open position and closed position, the ring 12 is considered to be positioned perpendicular to an axis 20.

In the open position, the ring has a first inner diameter $d_1$. In the closed position, the ring has a second inner diameter $d_2$, which is lower than $d_1$.

The ring 12 comprises first assembly means by elastic interlocking with the external element 11. These first means comprise a rib 21 radially projecting towards the outside of the ring. When the ring 12 is in the open position, the rib 21 has a shape substantially complementary to the groove 17 and the tabs (18, 19) of the element 11.

The ring also comprises second assembly means by elastic interlocking with the external element 11. These second means comprise elements projecting outwards, in this case fins (22, 23) substantially symmetrical in relation to the axis 20. The fins (22, 23) have a profile of a portion of a convex cone, which widens as the distance from the rib 21 increases along the axis 20.

When the ring 12 is in the closed position, the fins (22, 23) have a shape substantially complementary to the frustoconical part 24, the groove 17 and the tabs (18, 19) of the element 11.

The profile of the fins (22, 23) in particular forms an acute angle with the axis 20, said angle being substantially equal to the angle $\alpha$.

FIGS. 2, 3*a*, 3*b*, 4, 5*a* and 5*b* show the different successive steps of a method for assembling the device 10.

Figure 2:
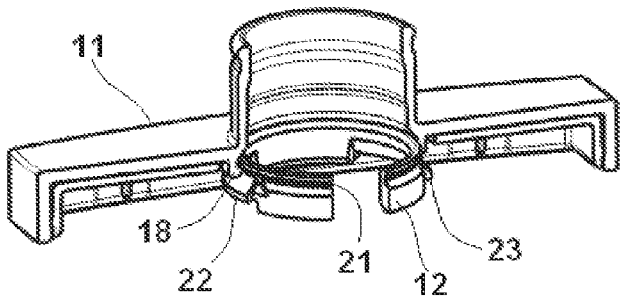
FIG. 2: A view of the elements represented in FIGS. 1*a*, 1*b* and 1*c* in their assembled form.

FIG. 2 shows a perspective view of the collar 11 assembled with the ring 12, according to a first step of said method. For improved visibility, the collar 11 is represented via its cross-section.

The ring 12 can be seen to be in the open position with the first assembly means carried by the ring cooperating with the assembly means carried by the tubular part 13 of the collar 11.

More precisely, the rib 21 of the ring is interlocked into the groove 17 of the collar, whereas the tabs (18, 19) of the collar are inserted between the rib 21 and the narrowest part of the fins (22, 23) of the ring. The respective positions of the collar 11 and the ring 12 are such that the axes (14, 20) merge.

Figure 3A:
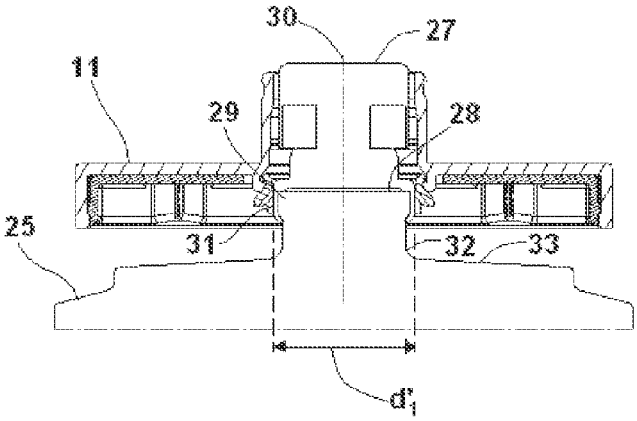
FIGS. 3*a* and 3*b*: A view of a device according to one embodiment of the invention, during the assembly process.
Figure 3B:
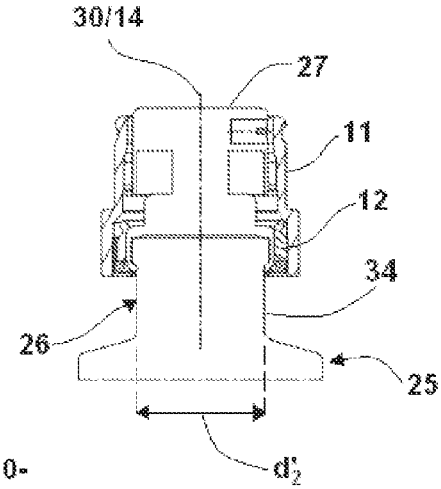

FIGS. 3*a* and 3*b* show a second step of the method for assembling the device 10. In these figures, the device 10, in addition to the collar 11 and the ring 12, can be seen to comprise an internal element 25. In the example represented in FIGS. 3*a* and 3*b*, the internal element is a container 25 equipped with a neck 26, on which the collar 11 and ring 12 are interlocked.

FIGS. 3*a* and 3*b* are cross-sectional views of the device 10 according to two cross-sectional planes perpendicular to each other, each of said planes passing via the axis 14.

In the example represented in FIGS. 3*a* and 3*b*, the neck 26 of the container 25 is equipped with a dispensing device 27, only the profile of which is schematically represented. The device 27 is, for example, a push actuator, which can be connected to a dispensing pump for dispensing a fluid contained within the container 25.

The neck 26 has a substantially cylindrical shape along an axis 30. In the example provided in FIGS. 3*a* and 3*b*, the neck has a circular cross-section. Alternatively, the cross-section can be oval.

At its open end 28, the neck 26 comprises a flange 29. Said flange or rim 29 supports crimping 31, which enables it to be connected to the device 27. The collar 11 is designed to be positioned on top of the neck 26 to hide the crimping 31.

At its other end 32, the neck 26 is connected to a shoulder 33 formed by the container 25.

In the second step of the method for assembling the device 10, the collar 11/ring 12 assembly represented in FIG. 2 is positioned on the neck 26. The respective positions of the collar 11 and the neck 26 are such that the axes (14, 30) merge.

At the flange 29, the neck 26 has a first visible outer diameter $d'_1$. In the example represented in FIG. 3*a*, this diameter $d'_1$ takes into account the thickness of the crimping 31. Alternatively, the flange 29 is not used to support crimping and the diameter $d'_1$ corresponds to that of the flange itself.

The outer diameter $d'_1$ is substantially equal to the inner diameter $d_1$ of the ring 12 in the open position. Preferably, $d'_1$ is slightly lower than $d_1$ so as not to hinder the passage of the ring.

Therefore, in the second step of the assembly method, the ring 12 can be positioned around the flange 29, as represented in FIGS. 3*a* and 3*b*. This second step, which can take place mechanically, ensures the centering of the collar 11/ring 12 assembly around the neck 26 and the push actuator 27.

Figure 4:
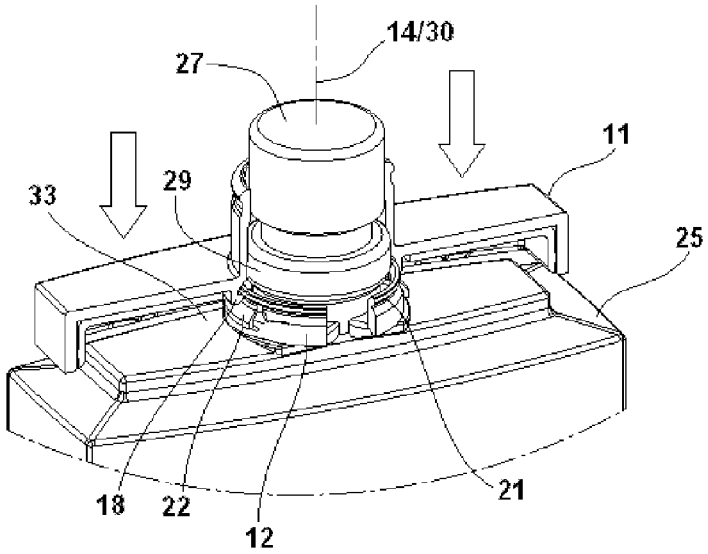
FIG. 4: A view of the device in FIGS. 3*a* and 3*b* during the assembly process.

FIG. 4 shows a third step of the method for assembling the device 10. This figure shows a perspective view of the collar 11 assembled with the ring 12 and with the container 25. For improved visibility, the collar 11 is represented via its cross-section.

According to the third step of the assembly method, a pushing force is exerted on the collar 11 parallel to the axis 14, in the direction of the container 25. In FIG. 4, the pushing force is represented by white arrows. This pushing step can take place mechanically.

Therefore, the collar 11/ring 12 assembly slides around the neck 26 towards the shoulder 33.

The ring therefore crosses the flange 29 and is positioned around a narrower part 34 (see FIG. 3*b*) of the neck 26. At the part 34, the neck 26 has a second outer diameter $d'_2$, lower than $d'_1$.

The movement of the ring 12 stops when said ring abuts against the shoulder 33.

As the pushing force exerted on the collar 11 continues, the frustoconical part 24 that borders the groove 17 exerts an inwards radial force on the rib 21. More precisely, as the rib 21 slides along the frustoconical part 24, the ring 12 progressively reduces in diameter by passing from the open position to the closed position.

Simultaneously, an inwards radial force is exerted by the tabs (18, 19) of the collar on the fins (22, 23) of the ring, such that said tabs move in relation to said fins along the axis 14.

The collar 11 therefore moves in relation to the ring 12 towards the container 25, whereas the ring 12 closes by reducing its inner diameter.

Figure 5A:
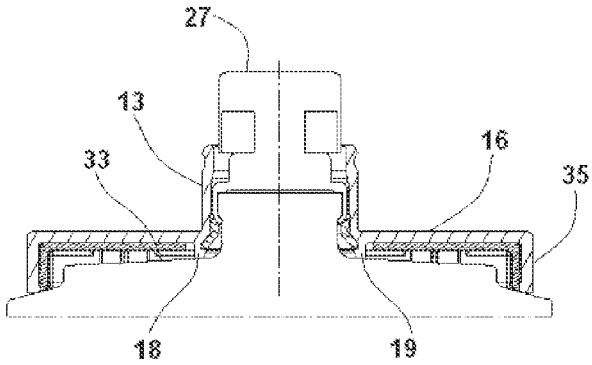
FIGS. 5*a* and 5*b*: Views of the device in FIGS. 3*a*, 3*b* and 4 in their assembled form.
Figure 5B:
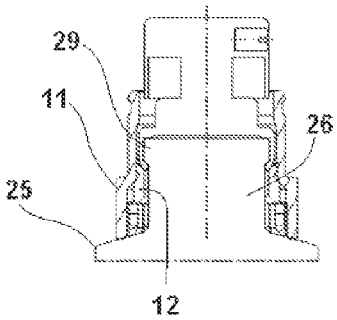

FIGS. 5*a* and 5*b* show the final configuration of the assembled device 10.

FIGS. 5*a* and 5*b* are cross-sectional views of the device 10 according to the cross-sectional planes of FIGS. 3*a* and 3*b* respectively.

In the final position represented in FIG. 5*a*, the tabs (18, 19) of the collar 11 can be seen to be snapped onto the end of the fins (22, 23) of the ring 12. Furthermore, the convex frustoconical surface of said fins is in contact with the frustoconical part 24 of the groove 17.

The ring 12 is in the closed position and positioned around the narrow part 34 of the neck 26. The inner diameter $d_2$ of the ring is substantially equal to the outer diameter $d'_2$ of the part 34.

Given that the diameter of the ring has reduced in relation to the previous step, the flange 29 blocks the ring 12 in translation in relation to the neck 26 along the axis 30. Furthermore, the snapping of the tabs (18, 19) onto the fins blocks the collar 11 in translation in relation to the ring 12. The device 10 formed by the ring 12, the collar 11 and the container 25 is therefore irreversibly assembled by elastic interlocking.

Furthermore, the tabs (18, 19) are in abutment against the shoulder 33, with a potential low level of clearance so as not to excessively stiffen the assembly. Similarly, an edge 35 of the plate 16 of the collar 11 abuts against the container 25. The translational clearance of the collar 11 along the axis 14 in relation to the container 25 is therefore almost zero.

A solid and stable assembly is thus obtained, where the part 13 of the collar is positioned around the neck 26 so as to hide the crimping 31. Furthermore, the external surface of the tubular part 13 is capable of housing a cap designed to protect the push actuator 27.

Such a device 10 is particularly well suited to the manufacture of packaging for a cosmetic product, said product capable of being stored in the container 25.

The invention claimed is:

1. An assembly device comprising:

an external element comprising a tubular part extending along a first axis;

an open-loop ring being elastically deformable between an open position characterized by a first inner diameter of the ring and a closed position characterized by a second inner diameter of the ring, the second diameter being less than the first diameter;

wherein the external element comprises an assembly part assemblable with the ring by elastic interlocking, the assembly part comprising at least one of recessed elements or projecting elements arranged on an internal wall of the tubular part;

wherein the ring comprises a first assembly part assemblable with the external element by an elastic interlocking, the first assembly part comprising first elements positioned on an external wall of the ring, said first elements having a shape complementing the elements positioned on the internal wall of the tubular part, said shape being complementary when the ring is in the open position; and wherein the ring comprises a second assembly part assemblable with the external element by an elastic interlocking, the second assembly part comprising second elements positioned on the external wall of the ring, said second elements having a shape complementing the elements positioned on the internal wall of the tubular part, said shape being complementary when the ring is in the closed position.

2. A device according to claim 1, wherein at least one of the ring or the external element comprise elements configured to form an acute angle with the first axis with the ring in assembly with the external element.

3. A device according to claim 1, further comprising an internal element fitted with a substantially cylindrical neck extending along a second axis, said neck comprising a flange at a first end and connected to a shoulder forming an abutment at a second end, the neck having a first outer diameter at said flange and being substantially equal to the first inner diameter of the ring and having a second outer diameter at a predetermined position away from said flange and being substantially equal to the second inner diameter of the ring.

4. A device according to claim 3, wherein the internal element is a container having a neck fitted with a device for dispensing a fluid product.

5. A method for assembling a device according to claim 3, comprising the steps of:

positioning the ring in the open position in the tubular part of the external element, the assembly part of the external element being interlocked with the first assembly part of the ring;

positioning the ring and the external element around said flange of the neck to bring the first axis in line with the second axis;

exerting a pushing force on the external element in a direction of the second end of the neck, such that the ring abuts against the shoulder;

inducing a radial force towards a center of the ring, by a movement of the external element in relation to the ring along the axes, to move the ring into the closed position; and interlocking the assembly part of the external element with the second assembly part of the ring.

6. A device according to claim 2, further comprising an internal element fitted with a substantially cylindrical neck extending along a second axis, said neck comprising a flange at a first end and connected to a shoulder forming an abutment at a second end, the neck having a first outer diameter at said flange and being substantially equal to the first inner diameter of the ring and having a second outer diameter at a predetermined position away from said flange and being substantially equal to the second inner diameter of the ring.

7. A device according to claim 6, wherein the internal element is a container having a neck fitted with a device for dispensing a fluid product.

8. A method for assembling a device according to claim 6, comprising the steps of:

positioning the ring in the open position in the tubular part of the external element, the assembly part of the external element being interlocked with the first assembly part of the ring;

positioning the ring and the external element around said flange of the neck to bring the first axis in line with the second axis;

exerting a pushing force on the external element in a direction of the second end of the neck, such that the ring abuts against the shoulder;

inducing a radial force towards a center of the ring, by a movement of the external element in relation to the ring along the axes, to move the ring into the closed position; and interlocking the assembly part of the external element with the second assembly part of the ring.

9. A method according to claim 8, wherein the radial force towards the center of the ring is induced by the relative axial movement of the elements configured to form said acute angle with the first axis.

* * * * *